United States Patent [19]

Jacobson

[11] Patent Number: 4,986,103

[45] Date of Patent: Jan. 22, 1991

[54] APPARATUS FOR COILING SPRINGS WITH TUCKED ENDS

[75] Inventor: D. John Jacobson, Southington, Conn.

[73] Assignee: Newcomb Spring Corp., Southington, Conn.

[21] Appl. No.: 520,634

[22] Filed: May 8, 1990

[51] Int. Cl.[5] ..... B21F 3/02; B21F 35/02

[52] U.S. Cl. ..... 72/137; 140/89

[58] Field of Search ..... 29/173; 72/131, 132, 72/135, 137, 138, 371; 140/89, 103

[56] References Cited

U.S. PATENT DOCUMENTS

| | | | |
|---|---|---|---|
| 1,466,363 | 8/1923 | Hamilton | 29/173 X |
| 2,404,424 | 7/1946 | Balla | 72/138 X |
| 4,571,973 | 2/1986 | Morita | 72/137 |
| 4,719,683 | 1/1988 | Ulbing | 29/173 |

FOREIGN PATENT DOCUMENTS

| | | | |
|---|---|---|---|
| 545598 | 3/1932 | Fed. Rep. of Germany | 72/135 |
| 396157 | 8/1973 | U.S.S.R. | 72/135 |

*Primary Examiner*—E. Michael Combs

*Attorney, Agent, or Firm*—Chilton, Alix & Van Kirk

[57] ABSTRACT

A coiling machine employs an apparatus wherein a coil spring having tucked ends may be formed at the coil forming station. After the helical coil is formed, a slider member engages the next to the last formed loop of the coil and forces the loop over the trailing or last formed loop of the coil. The coil is then severed from the wire supply so as to form a coil spring having a tucked trailing end.

12 Claims, 2 Drawing Sheets

APPARATUS FOR COILING SPRINGS WITH TUCKED ENDS

BACKGROUND OF THE INVENTION

This invention relates generally to spring coiling machines and spring forming processes. More particularly, the present invention relates to automated coiling machines for producing helical coil springs of various configurations and to the manufacturing of coil springs having tucked ends.

The basic construction and operating principles of spring coiling machines conventionally parallel those set forth in representative U.S. Pat. No. 2,119,002 issued on May 31, 1938, for a "Spring Coiling Machine", and U.S. Pat. No. 2,831,570 issued on Apr. 22, 1958, for "Wire Coiling Machine Having Cams for Holding The Feed Rolls Separated". The coiling machine described in U.S. Pat. No. 2,119,002 has features for permitting the operator to adjust the initial settings and cam-controlled movement of various tools and devices that determine the ultimate characteristics of the fabricated coil springs. The characteristics may include a uniform or variable spacing between turns and a uniform or variable turn diameter.

For a number of spring applications, it is desirable to tuck the leading and/or trailing ends of the coil spring. In some applications, it is desirable to have a coil spring wherein both ends of the spring are tucked so that the ends of the spring cannot interfere with the bearing surface of the closed or square end of the spring.

In conventional coiling machine operations, the leading end of the spring can be tucked by means of applying an initial tension to the formed spring. The leading end tuck may be accomplished at the coil forming station as the first and second coils are being formed by appropriate setting and operation of the coiling point and the pitch tool of the coiling machine.

However, in manufacturing processes wherein it is desired to also tuck the trailing end of the coil spring, the conventional spring coiling machines do not provide an efficient means for accomplishing the trailing end tuck operation at the coil forming station. The trailing end of the coil is conventionally tucked by first forming the coil spring, and then "kicking" in the end portions of the spring in a separate operation after the spring has been transferred from the spring coiler to another work station. Because the tucking process is essentially a separate manufacturing process, the manufacturing costs associated with coil springs having tucked ends and the difficulties in performing the tucking process result in significant costs and inefficiencies.

SUMMARY OF THE INVENTION

Briefly stated, the invention in a preferred form is a spring coiling machine having a coil forming assembly comprising a form arbor, a wire guide, a coiling point and a pitch tool. A supply of wire feeds between the wire guide and the form arbor and between the coiling point and the arbor against the pitch tool. The wire is deformed into a helical coil having a leading end and a trailing end and comprising a continuous series of generally helical loops. A cutter severs the coil from the supply of wire. An engagement member such as a shoulder on the arbor is fixably engaged by the trailing end of the coil. A tucking slider is displaceable and configured for engagement with the next to last formed loop coil to force the trailing end of the coil against the engagement member so that the last formed loop is forwardly axially positioned in relation to the next to the last formed loop. The trailing end of the coil is thereby tucked. The coil is severed by the cutter while the coil remains in the coil forming assembly to thus provide a helical coil spring having a tucked trailing end.

The engagement member may take the form of a retainer slider which is projectable to engage the trailing end portion of the coil. The retainer slider is projected prior to or in coordination with activation of the tucking slider. The cutter traverses the space between the next to the last formed loop and the last formed loop and severs the coil from the wire supply. The coiling point is also retracted in coordination with the activation of the tucking slider.

A process for manufacturing a coil spring having a tucked end comprises forming a coil comprising a continuous series of helical loops and having a leading end and a training end portion extending from the wire supply. The next to the last formed loop is forced over the last formed loop so that the last formed loop is located between the next to the last formed loop and the leading end of the coil. The trailing end portion of the coil is then severed from the wire supply. The last formed loop is restrained against displacement and the next to the last formed loop is engaged and displaced relative to the last formed loop. The trailing end portion is severed while the last formed loop is positioned between the next to the last formed loop and the leading end of the coil.

An object of the invention is to provide a new and improved spring coiling machine having an apparatus to tuck the trailing end of a spring.

Another object of the invention is to provide a new and improved spring coiling machine which is capable of tucking the trailing end of a spring at the coil forming station.

A further object of the invention is to provide a new and improved apparatus and process for manufacturing coil springs having tucked ends in an efficient and cost effective manner.

Other objects and advantages of the invention will become apparent from the drawings and the specification.

DESCRIPTION OF THE PREFERRED EMBODIMENTS

Figure 6:
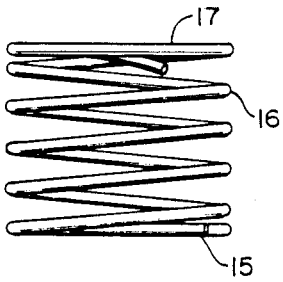
FIG. 6 is a side view of a coil spring having a tucked trailing end manufactured by the spring coiling machines and apparatus of FIGS. 1–5.
Figure 7:
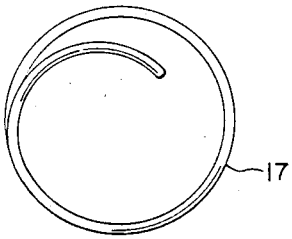
FIG. 7 is an end view of the coil spring of FIG. 6.

With reference to the drawings wherein like numerals represent like parts throughout the several figures, a spring coiling machine incorporating an apparatus for tucking the trailing end of a coil spring is generally designated by the numeral 10. The spring coiling machine incorporates an apparatus 12 which is adapted for forming a coil spring such as spring 16 illustrated in FIG. 6. The spring 16 is tucked at both the leading end 15 and the trailing end 17 and is completely formed within the coil forming station of the machine, as will be detailed in the specification below. The spring 16 may be entirely formed at the coil forming station without requiring subsequent transfer to another work station for deforming the end of the spring to the tucked end configuration of FIG. 6. The leading and trailing ends 15 and 17, respectively, refer to the initial and last formed ends of the spring. The formation of a tucked end at the leading end of a coil spring is conventional and will not be detailed.

Spring coiling machine 10 may be any of numerous makes and models which are employed for manufacturing coil springs in an automatic highly efficient process. A preferred embodiment which is employed for describing the present invention is a single point spring coiling machine such as model W11A marketed by the Torin Corporation of Torrington, Connecticut. It should be understood that the principles and advantages of the invention are applicable to other makes of coiling machines. The basic operating features and principles of the Torin machines are described in U.S. Pa. No. 2,119,002, the disclosure of which is hereby incorporated by reference. The description herein for purposes of illustration and clarity is made with reference to the manufacture of a right-handed coil or spring. However, it will be apparent to those familiar with the technology that the description applies equally to the manufacture of left-handed coils by reversing the mounting orientation of parts and tools such as guides, arbors, cutters, etc., as appropriate.

A typical coiling machine 10 of the type disclosed in U.S. Pat. No. 2,119,002 employs a multiplicity of gears, linkages, levers, cams and power supplies, all of which are operatively integrated for the purpose of feeding a wire 18 through to a coiling station 20. The wire is plastically deformed at the coiling station into a coil spring having the desired characteristics such as diameter (which may vary in a given coil), length and pitch. The coil spring is then cut from the wire 18 and the manufacturing sequence replicated so that multiple coil springs are produced without interruption in a continuous highly efficient manufacturing process.

Figure 1:
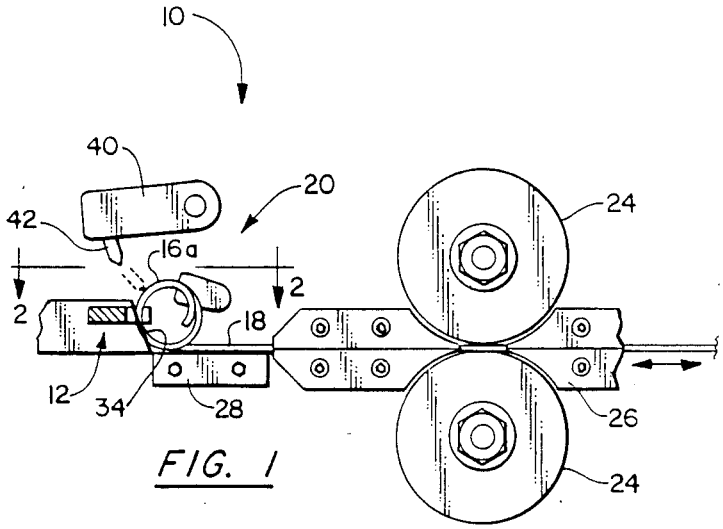
FIG. 1 is a fragmentary front interior view, partly in schematic, of a wire workpiece and a spring coiling machine incorporating a tucking apparatus in accordance with the present invention.
Figure 3:
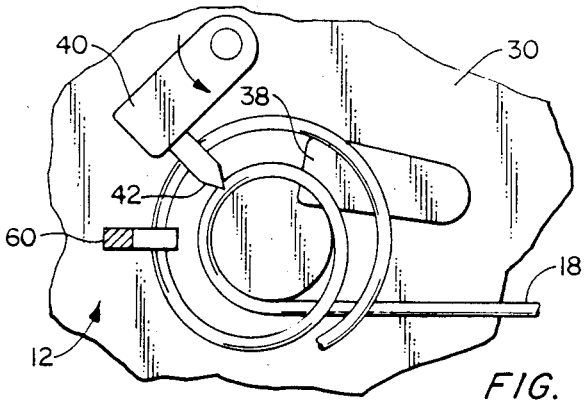
FIG. 3 is a sectional view of the coiling machine apparatus and wire taken along the line 3—3 of FIG. 2*b*, said view illustrating the cutting stage in manufacturing a coil spring.

With reference to FIG. 1, the coiling station 20 of coiling machine 10 operates on a work piece in the form of wire 18 to produce the coil spring 16. The supply wire 18 is displaced (to the left in FIG. 1) by feed rolls 24 through wire guides 26 and block wire guides 28. The wire is continuously displaced parallel to the front face of panel 30 of the machine until it reaches the arbor 32. The arbor 32 is mounted in a chuck at panel 30 of the machine and extends outwardly (from the plane of FIG. 1) toward the operator. A coiling point 34 contacts the wire as it emerges from in between the arbor 32 and the block guide 28 and deformably forces the wire into a generally helical shape. In FIGS. 1 and **2*a*, the unfinished coil spring 16*a* is illustrated as a quasi-annular member around the arbor which extends outwardly from the plane of FIG. 1. A pitch tool 38 is wedged at an angle to the wire as it passes around the arbor to thereby establish the pitch or relative spacing between successive loops or turns in the coil. When the coil spring reaches the desired number of turns or length (designated as coil spring 16*b*), a cutting tool 40 in the form of a tension assembly having a projecting cutting blade 42 is actuated. The blade 42 is pivotally displaced from the upper left in the direction of the FIG. 3 arrow to sever the feed wire (against the arbor 32) and complete the fabrication of the coil spring 16**.

Controllers (not illustrated) for moving the coiling point 34 toward and away from the arbor 32 to thereby control the diameter of the given loop or turn are conventionally employed. Controllers (not illustrated) for controlling the orientation of the pitch tool 38 by typically moving the pitch tool 38 toward or away from the front panel 30 of the machine to thereby define the pitch of the spring coils are also conventionally employed. The structures for attaching, connecting and controlling the fixed or moving parts as depicted in the drawings are well known in the art and are more fully described in the referenced U.S. Pat. No. 2,119,002.

The leading end 15 of the coil spring is formed at the coiling station by "kicking in" the leading end by applying an initial tension to the first coil or initial leading end of the spring. This tension may be applied by a slider or suitable member of conventional form and function. It is conventional to tuck the leading end of the coil by means of the initial axial tension applied to the leading end of the coil.

In accordance with the invention, the machine 10 additionally employs an apparatus 12 which functions to impose a tucked end at the trailing end of the spring while the spring remains at the initial coil forming station. The arbor 32 includes a shoulder 52 which is sufficiently large to engage a pre-established wire thickness. The spring is initially wound using the torsion attachment, the coiling point, the arbor and the pitch tool in a generally conventional fashion for forming the helical coil spring.

Figure 2A:
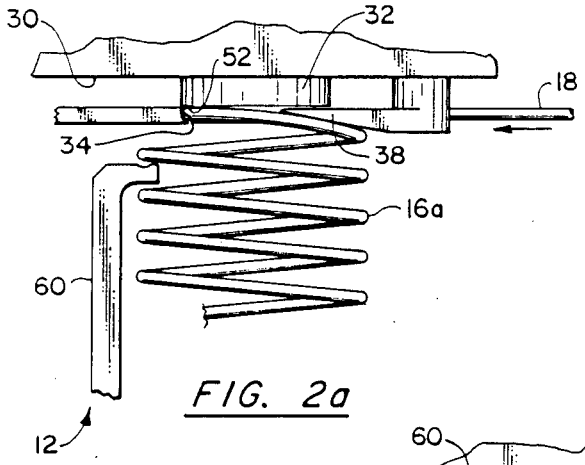
FIG. 2*a* is an enlarged fragmentary top interior view, partly in schematic, of the coiling machine apparatus and wire taken along the line 2—2, said view illustrating the coil forming stage of FIG. 1.
Figure 2B:
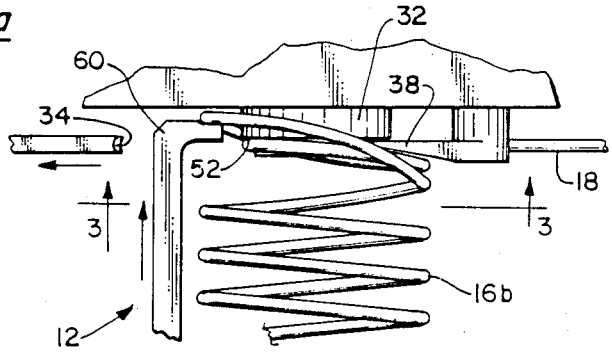
FIG. 2*b* is an enlarged fragmentary top interior view, partly in schematic, of the coiling machine apparatus and wire of FIG. 1, said view illustrating the tuck forming stage in manufacturing a coil spring.

After the coil spring has been formed and prior to activating the cutter to sever the formed coil spring from the wire workpiece, a slider 60 is automatically activated. The slider 60 reciprocates by means of a fluid actuated cylinder (not illustrated). The slider is configured and oriented to engage the next to last formed loop to push back the coil loop rearwardly over the arbor so that the next to the last formed loop is essentially axially displaced rearwardly (toward panel 30) from the last formed loop as illustrated in FIG. **2*b*. The coiling point 34 is automatically retracted away from the end loop of the coil spring in coordination with the slider 60. The slider forces the trailing end portion of the wire against the shoulder 52 of the arbor to impose a tucked end. While the slider 60 is activated in the redacted tucking mode, the cutter is activated so that the cutter blade 42 passes between the last loop and the second to the last loop (in the redacted mode of FIGS. 2*b* and 3) thereby severing the formed coil spring 16 from the wire workpiece. The slider 60** then automatically retracts and the torsion assembly pivotally returns upwardly to begin the replication of the coil forming cycle.

It should be appreciated that the shoulder 52 on the arbor functions as a retention bearing surface to restrain the last formed loop from moving back along with the next to the last formed loop when the slider 60 is activated to redact the coil spring. Furthermore, the redacting and bending of the next to the last loop over the last loop produces a permanent set wherein the last loop portion does not substantially extend rearwardly through the same transverse plane as the next to the last loop. Thus, a tucked end of the helical coil spring is produced at the trailing end (as well as the leading end) while the coil spring remains at the coil forming station.

Figure 4:
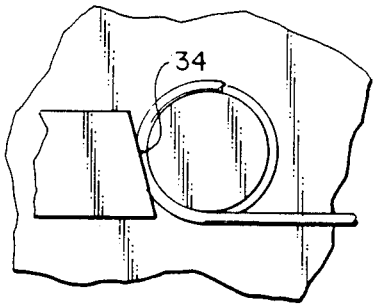
FIG. 4 is a fragmentary front interior view of a spring coiling machine incorporating an alternate embodiment of a tucking apparatus in accordance with the present invention.
Figure 5:
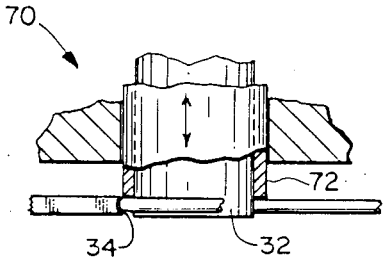
FIG. 5 is a fragmentary top interior view, partly in section and partly in schematic, of the apparatus embodiment of FIG. 4.

With reference to FIGS. 4 and 5, a second embodiment of an apparatus for tucking the trailing end of a formed coil spring, is generally designated by the numeral 70. A slider 72 is mounted adjacent the arbor 32 in the tool chuck. Prior to forming the last helical loop of the spring, the slider 72 is activated to axially engage against the last formed loop to function as a retaining shoulder similar to that of fixed shoulder 52. The retainer slider 72 is employed for applications wherein an arbor shoulder would not provide sufficient bearing area for restraining the redaction of the coil spring.

The retainer slider 72 is activated to push the wire forwardly prior to the slider 60 mounted at the front of the tool being activated to push the next to the last loop of the spring back over the arbor as previously described. The spring is wound in a conventional manner. Prior to activation of the cutter, the coiling point 34 is displaced from engagement with the wire. The slider 60 thus cooperates with slider 72 to force the trailing portion of the wire against the slider 72. The cutter is activated with the cutter blade 42 passing between the last formed loop and the second to the last formed loop to thereby sever the spring from the wire workpiece. Both sliders retract and the torsion arm comes back so that the described coil forming cycle may be replicated.

It should be appreciated that both apparatus 12 and 70 function to modify a conventional machine so that both ends of the formed coil spring may be tucked without requiring transfer to another work station. Moreover, the formation of the tucked ends is accomplished at the coil forming station in a highly efficient, cost effective manner so that the tucked coil springs may be formed in a continuous fashion.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A spring coiling machine comprising:

a form arbor;

a block wire guide in close spaced relationship to the form arbor;

a coiling point in close side spaced relation to the form arbor;

a pitch tool in close side spaced relation to the form arbor generally opposite the coiling point;

feeding means for feeding a supply of wire between the wire guide and the form arbor and between the coiling point and the form arbor against the pitch tool such that during said feeding the wire is deformed into a coil having a leading end and a trailing end with a continuous series of generally helical loops being continuously formed in order from the leading end to the trailing end;

engagement means for fixable engagement by the trailing end of said coil;

slider means selectively activatable for engagement with the said coil to force the coil against said engagement means so that a last formed loop is forwardly positioned between a next to last formed loop and the leading end of said coil; and cutter means for severing the coil from the supply of wire;

wherein the trailing end of said coil is tucked by cooperation of said slider means and engagement means and the coil is severed by said cutter means to provide a helical coil spring having a tucked trailing end.

2. The coiling machine of claim 1 wherein the engagement means comprises a shoulder extending from said arbor.

3. The coiling machine of claim 1 wherein the engagement means comprises a retainer slider which is projectable to engage said coil.

4. The coiling machine of claim 3 wherein said retainer slider is projected prior to activation of said slider means.

5. The coiling machine of claim 4 wherein the cutter means traverses the space between the next to last formed loop and the last formed loop and severs the coil from the wire supply against the arbor.

6. The coiling machine of claim 1 wherein the coiling point is retracted substantially simultaneously with the activation of the slider means.

7. A spring coiling machine comprising:

coil forming means for deforming a workpiece portion of a supply of wire into a coil comprising a series of helical loops continuously formed in sequence from a leading end to a trailing end;

engagement means for fixable engagement of the trailing end of said coil;

slider means displaceable for engagement with the coil to force the trailing end of said coil against said engagement means so that a last formed loop is positioned between a next to last formed loop and the leading end of said coil;

cutter means for severing the coil from the supply of wire;

wherein the trailing end of said coil is tucked at the coil forming means to produce a helical coil spring having a tucked trailing end.

8. The coiling machine of claim 7 wherein the coil forming means comprises an arbor and wherein the engagement means comprises a shoulder extending from said arbor.

9. The coiling machine of claim 7 wherein the engagement comprises a retainer slider which is projectable to engage said coil.

10. The coiling machine of claim 9 wherein said retainer slider is projected in cooperation with activation of said slider means.

11. The coiling machine of claim 10 wherein the cutter means traverses the space between the next to the last formed loop and the last formed loop to sever the coil from the wire supply.

12. The coiling machine of claim 7 wherein the coil forming means comprises a coiling point and wherein the coiling point is retracted in coordination with the activation of the slider means.

* * * * *